US005518981A

United States Patent [19]

Nelson et al.

[11] Patent Number: 5,518,981

[45] Date of Patent: May 21, 1996

[54] XEROGRAPHABLE CARBONLESS FORMS

[75] Inventors: Richard Nelson, Nashua; Pat Y. H. Wang, Londonderry, both of N.H.

[73] Assignee: Nashua Corporation, Nashua, N.H.

[21] Appl. No.: 346,842

[22] Filed: Nov. 30, 1994

Related U.S. Application Data

[63] Continuation of Ser. No. 846,823, Mar. 6, 1992, abandoned.

[51] Int. Cl.[6] ..... B41M 5/136; B41M 5/155

[52] U.S. Cl. ..... 503/201; 427/150; 430/97; 503/214

[58] Field of Search ..... 430/97; 503/201, 503/215, 214; 427/150

[56] References Cited

U.S. PATENT DOCUMENTS

| | | | |
|---|---|---|---|
| 2,711,375 | 6/1955 | Sandberg . | |
| 3,016,308 | 1/1962 | Macaulay . | |
| 4,032,690 | 6/1977 | Kohmura et al. . | |
| 4,042,412 | 8/1977 | Williams . | |
| 4,082,688 | 4/1978 | Egawa et al. . | |
| 4,138,362 | 2/1979 | Vassiliades et al. . | |
| 4,154,462 | 5/1979 | Golden et al. . | |
| 4,230,743 | 10/1980 | Nakamura et al. . | |
| 4,271,224 | 6/1981 | Mizuno et al. . | |
| 4,339,275 | 7/1982 | Tutty . | |
| 4,348,234 | 9/1982 | Cespon . | |
| 4,352,901 | 10/1982 | Maxwell et al. . | |
| 4,396,670 | 8/1983 | Sinclair . | |
| 4,397,483 | 8/1983 | Hiraishi et al. . | |
| 4,822,416 | 4/1989 | Langlais et al. . | |
| 4,822,770 | 4/1989 | Sud et al. | 503/214 |
| 5,084,443 | 1/1992 | Kraft | 430/32 X |

FOREIGN PATENT DOCUMENTS

| | | | |
|---|---|---|---|
| 0134818 | 8/1984 | European Pat. Off. | 503/215 |
| 0274886 | 7/1988 | European Pat. Off. | 503/215 |
| 2176203 | 12/1986 | United Kingdom | 503/215 |
| 1280769 | 7/1972 | WIPO . | |

*Primary Examiner*—B. Hamilton Hess
*Attorney, Agent, or Firm*—Testa, Hurwitz & Thibeault

[57] ABSTRACT

The invention relates to a process for producing multi-layered carbonless sheets on which indicia can be xerographically produced with little or no non-specific development. The process involves coating a sheet with a CB composition containing a carboxymethyl cellulose polymer, a crosslinker, a salt of a polyvalent metal ion and a small amount of a wall forming acrylic resin. The CB coating formed resists breakage and release of dye when non-specific pressure is applied to the sheet thereby resulting in CF copies having improved brightness and reduced non-specific development.

7 Claims, 6 Drawing Sheets

Image Legibility

ORIGINAL TYPED IMAGE

XEROGRAPHABLE CARBONLESS FORMS

This is a continuation of application Ser. No. 07/846,823 filed on Mar. 6, 1992, now abandoned.

BACKGROUND OF THE INVENTION

This invention relates to interleaved carbonless forms comprising pressure-sensitive coated-back sheets and coated front receiver sheets which can be printed xerographically and which resist smudging caused by non-specific development of the coated front receiver sheets.

Carbonless copy paper comprises to or more juxtaposed sheets. The back surfaces of the sheets have a coating containing a color-forming material often referred to as a "coated back" or "CB" coating. The coating consists of a continuous matrix or microcapsules containing a pale or colorless color-forming material which is designed to rupture and release the color-former when a threshold pressure is applied to the front or opposite side of the sheet. The front surfaces of the receiver sheets, which in use are placed in contact with the coated back surfaces of the overlaid sheets, are coated with a composition containing a developer component reactive with the color-forming material in the CB sheets which are capable of changing it to colored condition. These sheets are referred to as "coated front" or "CF" sheets. The multi-layered set of carbonless forms will consist of a top sheet having only a CB coating, a bottom sheet having only a CF coating and one or more intervening sheets having both CB and CF coatings. Typically, the forms also include printed indicia on the top surface of at least the top sheet and one or more of the underlying sheets, and blank spaces where information is filled in by writing or typing. Upon the application of pressure to the top sheet, the CB coatings are ruptured thereby releasing the color-forming material imagewise to contact, react with and form a visible color in the developer coating on the CF sheets. A visible color image is produced in areas corresponding to the locations when pressure has been applied to release the color-forming material. Pressure applied to the top sheet causes a corresponding mark on the front of each sheet in the manifold set. Thus, multiple "carbon" copies can be made at once.

These carbonless forms are widely used in business, particularly in retailing. One drawback to these sheets is that the application of non-specific pressure, such as a heavy object being placed on the sheets, can rupture the CB coating, causing smudging or non-specific development of the underlying CF sheets. Non-specific development can occur when CB forms are xerographically reproduced due in part to the pressure of the feeder and/or fuser rolls in the copier. The same problem can occur when carbonless sheets are run through laser printers. Carbonless paper is needed which resists non-specific development but forms clear copies when specific pressure is applied.

SUMMARY OF THE INVENTION

The present invention relates to a method for manufacturing carbonless forms by xerographically producing printed indicia onto CB/CF sheets which can be bonded together to form a multileaved set of manifold sheets. Each sheet in the set can be imprinted with the indicia of choice by running each sheet through a copier, for example, then stacking the sheets together to form a set of carbonless forms.

The method involves coating the back of the sheets with a CB coating composition which forms a layer having enhanced resistance to rupture under nonspecific pressure. As more specifically disclosed herein, the CB composition comprises carboxymethyl cellulose, an acrylic resin, a crosslinker, a leuco dye, spacer particles and a metal salt capable of inducing precipitation of the CMC. The object of the coating chemistry is to produce a coating having walls enveloping the leuco dye which will rupture readily upon writing or typing pressure, but will not rupture, and release dye, when passed through the rollers in a copier. The indicia then can be xerographically produced onto the top surface of all or some of the sheets. The multi-leaved sets contain a top sheet having the above-described pressure-resistant CB coating, optionally at least one intermediate sheet having the CB coating on the back and a standard CF coating on the front, and a bottom sheet having a CF coating.

Carbonless sheets as described herein exhibit enhanced whiteness and less non-specific development of the underlying CF sheets when the sheets are subjected to non-specific pressure, such as when objects are placed on the sheets, when the sheets are stacked together for storage, or when they are passed through the feeder and/or fuser rolls of a copier or printer. The CB coating of the forms of the present invention is designed to resist rupture when non-specific pressure is applied, but will selectively rupture to release the color-forming dye when specific pressure is applied, e.g., with a pen or typewriter, for example. The use of the improved CB coating permits multi-layered forms to be produced by xerography, rather than by printing methods which are more costly and time consuming. In addition, the present method and CB composition yields crisper images with better color and improved edge definition, even on the underlying sheets in the set. The resulting sheets are visually brighter.

Thus, a manufacturer of business forms or those seeking to produce customized carbonless forms can purchase or manufacture top, bottom and intermediate sheets of the type disclosed herein, load these into a copy machine and, using a master printed by any conventional technique, transfer the printed indicia from the master to the top face of any of the sheets making up the manifold form. Because of the resistance to non-specific release of dye in the CB, and the improved whiteness of the sheets, the forms so produced are essentially indistinguishable in both appearance and function from carbonless forms printed conventionally.

DETAILED DESCRIPTION OF THE INVENTION

Figure 1:
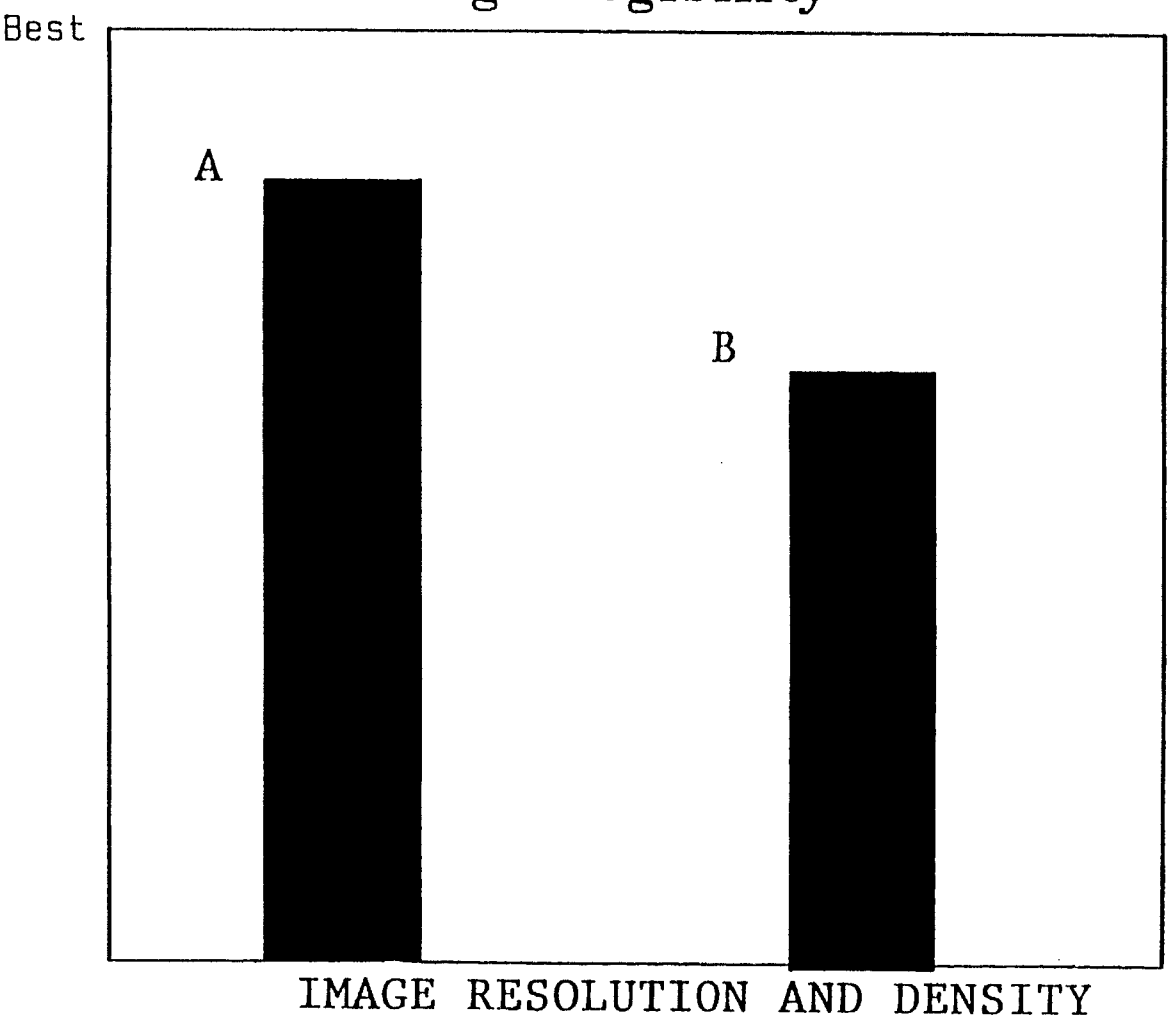
FIG. 1 is a graph comparing the degree of resolution of the image formed on sheets using the present CB coating compared to a competitive commercial coating.

The present method involves the following steps: coating the back of cellulosic sheets with a composition which forms a CB coating having superior resistance to non-specific pressure; coating the front of some of the sheets with a standard CF coating; and printing indicia onto the sheets by xerography using a master sheet containing the desired indicia. The top sheets typically will have a CB coating, the intermediate sheets will have both CB and CF coatings and the bottom sheet typically will have the CF coating. The sheets then can be assembled to produce the multi-leaved carbonless form.

In one embodiment, multileaved carbonless forms of the present invention are produced by first coating cellulosic sheets with a CB coating formulation comprising an emulsion of a carboxymethylcellulose (CMC) resin, a wall-forming acrylic resin, an organic crosslinker and a metal salt, preferably an aluminum salt. For each 100 parts (dry weight) of the CMC used, the composition contains between about 1 to 50 parts by weight of the acrylic resin, about 1 to 12.2 parts by weight of the aluminum or other metal salt, and about 10 to 150 parts by weight of a crosslinker which is reactive with the carboxymethyl cellulose and the acrylic resin.

The dispersion is a 25 to 40% solids aqueous emulsion, and can be applied by a standard coating method for forming a thin film, e.g., by knife, rod or curtain coating. The coating dries to form a coherent film on the the back of the paper. The dye is a basic, colorless leuco dye which reacts with an acidic color-developing material in the CF coating to form color when the materials come into contact.

The indicia of interest can be produced onto the sheets by any method, including printing. However, the CB coated sheets of the present invention exhibit enhanced resistance to breakage by non-specific pressure, therefore they can economically be run through a copier without adverse effects. In a preferred embodiment of the present method, the indicia are produced on the CB sheets by xerography. In this embodiment, the sheets made according to the present method are loaded into the feed tray of a copier, a master sheet containing the indicia of interest is placed on the glass, and a copy cycle is run, thereby imprinting the indicia on the non-CB side of the sheet. The sheets then can be assembled to form multi-leaved documents. The individual sheets in the multi-leaved set can be secured together, if desired.

The CB coating used to coat the sheets of the present invention comprises an oil-in-water emulsion which, when applied to sheets of paper and dried, forms a stable coating having improved imaging characteristics, whiteness and resistance to non-specific development. The coating is prepared by combining the CMC with a small amount of an acrylic resin, an organic cross-linker, and a metal salt capable of inducing precipitation of the CMC. The oil phase of the coating contains one or more colorless leuco dyes. The dyes are prevented from escaping by the crosslinked film formed by the reaction of CMC, the acrylic resin and the crosslinker.

More specifically, the formulation consists of an emulsion of an oil containing one or more color forming reactants in an aqueous solution of CMC having a degree of substitution in the range of about 0.65 to about 0.85, a small amount of a wall-forming acrylic resin, a salt of a polyvalent metal, an organic crosslinker and other optional ingredients present in amounts sufficient to provide a total solids content in the formulation of at least 25% by weight, preferably at least 28% by weight. The coating preferably has a viscosity sufficient for use with particular coating equipment and when coating at a selected web speed, generally in the range of 50 to 5000 centipoise (cps) as measured with a Brookfield viscometer. Percent by weight solids, as used herein, include all ingredients in the formulation other than water. In a preferred embodiment, the acrylic wall forming resin is a copolymer of a carboxylated polyethylacrylate/methylmethacrylate copolymer, most preferably in a ratio of about 2:1 ethylacrylate (EA) to methylmethacrylate (MMA). The organic crosslinker is preferably a polyamide-epichlorohydrin or another resin capable of forming crosslinks with both CMC and the carboxyl groups of the acrylic resin. The preferred metal salt is aluminum nitrate.

The formulation optionally can contain a fluorescent whitening agent.

In the currently preferred embodiment, the CMC employed has a viscosity of about 200 to 700 cps as a 6% aqueous solution and a degree of substitution of about 0.65 to 0.85.

The formulation is coated on the back of a sheet of paper forming a CB sheet having an adhered, dried coating of the type described above, which will release a color-forming dye when sufficient specific pressure is applied. The threshold pressure is high enough to prevent rupture of the coating when non-specific pressure is applied and subsequent non-specific development of the underlying CF sheets. This threshold is low enough to permit rupture of the coating when pressure is applied with a pencil, pen, typewriter keys or the print heads of computer and dot matrix printers, for example, to form a clear, intense image at the pressure points. The CB coating resists breakage under pressures of up to about 70 PSI at about 400° F.

The present CB composition is produced according to the following general procedure. CMC having a low viscosity and degree of substitution from about 0.65 to 0.85 is dissolved in water. The degree of substitution refers to the average number of carboxymethyl groups substituted per anhydroglucose unit..A high degree of substitution improves CMC's compatibility with other water-soluble components. The CMC used in accordance with this invention is preferably an alkali metal CMC, such as sodium CMC. An acrylic wall forming resin is added to this aqueous solution. It has been found that small amounts of the acrylic resin are most effective, preferably less than 50 parts by weight, more preferably less than about 20 parts by weight. Resins which are useful in the present invention include, for example, a carboxylated poly EA/MMA copolymer such as Carboset™ 514H manufactured by B. F. Goodrich, or Acrysol™ WS-24 which is a polybutylacrylate/styrene copolymer available from Rohm and Haas.

A solution of dyes in an oil solvent is then added to the acrylic resin-CMC solution. Suitable dyes and oil solvents are well known in the art. Preferred oil-dyes include basic, chromogenic lactone or phthalide dyes which are colorless or pale-colored and which develop color on contact with acidic materials ("color-developing materials"). The dyes are dissolved in an effective solvent such as an alkylbiphenyl. In a preferred practice the dye or dyes employed are dissolved at concentrations of 3–12% by weight in an active oil, resulting in a two-phase mixture.

A crosslinker, such as a cationic, water-soluble polyamide-epichlorohydrin resin which crosslinks the carboxymethylcellulose and the carboxylated acrylic water-soluble wall-forming resin, is added to the mixture. Other useful crosslinking agents include glyoxal, boric acid, and formaldehyde-donating resins, such as formaldehyde resins, melamine-formaldehyde resins and urea-formaldehyde resins. Preferred crosslinking agents include Kymene™ 557N, Kymene™ 557H and Kymene™ 557LX (all available from Hercules Inc.). These resins are high efficiency, cationic, wet-strength resins that function under acid or alkaline conditions. When the coating is applied to a substrate, the crosslinker reacts with the CMC and acrylic resin to form a strong, flexible a water-insoluble crosslinked film coating. The Kymene™ resins are reactive with both hydroxyl and carboxyl groups but react preferentially with carboxyl groups.

A solution of the metal salt (e.g., less than about 5% by weight) then is added to the emulsion. The metal salt is used in this CB formation to precipitate CMC. Aluminum salts are preferred for this purpose, in particular, aluminum nitrate and aluminum acetate.

Finally, a starch dispersion or a dispersion of other spacer particles is added to the mixture.

A fluorescent whitening agent optionally can be included in the formulation. Fluorescent whitening agents are materials which improve the visual brightness of an image and are well known in the art. Fluorescent whitening agents which are particularly useful for this purpose include stilbene-triazine derivatives such as, for example, Tinopal HST, available from Ciba-Geigy, Inc. The amount of fluorescent whitening agent added will be the amount needed to achieve the desired effect which can be determined empirically. Typically, from about 0.01 to about 1.0% (based or dry weight) is sufficient.

The resulting emulsion has a solids content of at least 25%. Its viscosity may vary widely, and can be adjusted for particular applications by decreasing the water content and/or using a higher viscosity CMC. For air knife coating, the viscosity of the composition as measured at 100 RPMs using a Brookfield RVF viscometer, #4 spindle, is preferably in the range of about 50–250 cps, most preferably about 60–100 cps; and for blade coating about 300–5000 cps. The particular viscosity will necessarily depend on the coating equipment to be used and on the coating speed.

The formulation is coated on the back of paper or another substrate, and dried. The coating weight is preferably greater than about 3.00 grams per square meter (dry weight) for use in carbonless copy systems. Upon the application of pressure to the substrate, the integrity of the coating is ruptured, and the color-forming dyes in the oil phase are released to contact the underlying CF sheet, which contains a color-developing material reactive with the dyes, thereby producing a colored image corresponding to the area where the pressure has been applied.

Essential ingredients of a preferred embodiment of the coating of the invention include CMC having a degree of substitution between 0.65 and 0.85 a wall-forming carboxylated acrylic resin, an organic cross-linker, and a metal salt. Preferably, for each 100 parts (dry weight) CMC used, the composition should contain between about 1–50 parts acrylic resin, between 10 and 150 parts cross-linker, between 300 and 1000 parts oil and dye, and between 1.0 and 12.2 parts metal salt. The metal salt is preferably aluminum nitrate ($Al(No_3)_3$) or aluminum acetate, preferably basically stabilized in boric acid ($CH_3CO_2Al(OH_2).1/3H_3BO_3$). Aluminum nitrate can be added in an amount of from about 4.4 to about 12.2 parts bases on 100 parts CMC. Preferably, about 5 to 6 parts are added. Aluminum acetate is added in an amount of about 1 to about 5 parts, preferably about 2 to 3 parts. Preferably, for each 100 parts CMC used, the wall forming resin should be present at about 10 to 20 parts, the cross-linker present at. 60 to 100 parts, the oil and dye present at 600–800 parts, and the metal salt present at 5–6 parts. Spacer particles, if used as preferred, are present in the range of 100–500, preferably 200–300, parts per 100 parts CMC.

Practice of the invention results in significant advantages over previous formulations. For example, a previous formulation is described in U.S. Pat. No. 4,822,416, the teachings of which are hereby incorporated herein by reference. The present formula described herein differs from the formula in U.S. Pat. No. 4,822,416 primarily in that it has less acrylic wall-forming resin, and uses a CMC having a lower degree of substitution and a higher viscosity. The CB coating formed from the above composition has significantly improved properties. The coating is less susceptible to non-specific development than previous CMC based CB compositions. Pressure testing of the present CB coating compared to prior art coatings has shown more than a 50% increase in static resistance Sheets coated with the present CB formula also exhibit a lower contact angle, which permits a stronger adhesive bond to form. This aspect allows the CB sheets of the present invention to be used to form multi-leaved sets which are glued together at one end with a fan-apart adhesive, for example.

Figure 2A:
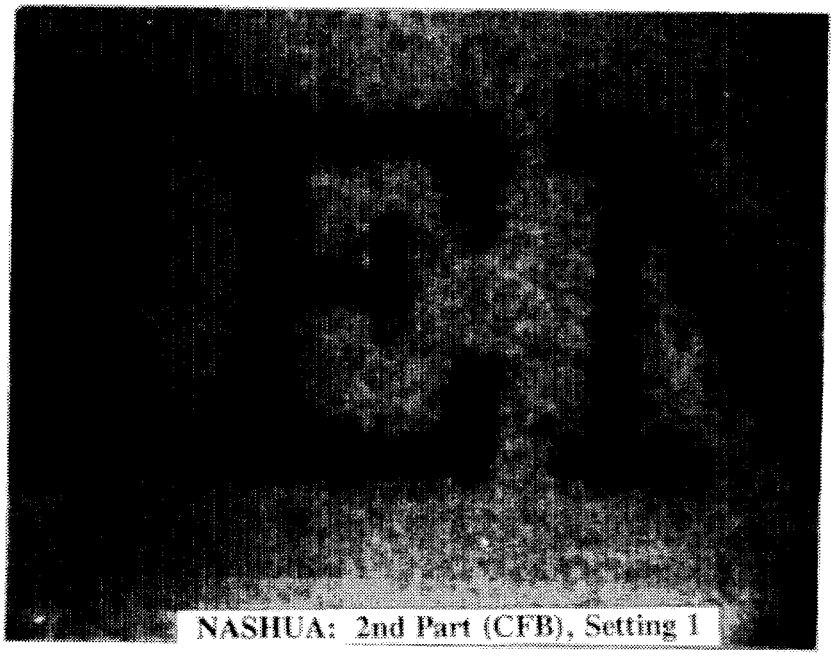
FIG. 2 illustrates the clarity of the image on the second CF sheet using the present CB coating (A) and a prior art coating (B), compared to the original typed image (C), all magnified 40 times.
Figure 2B:
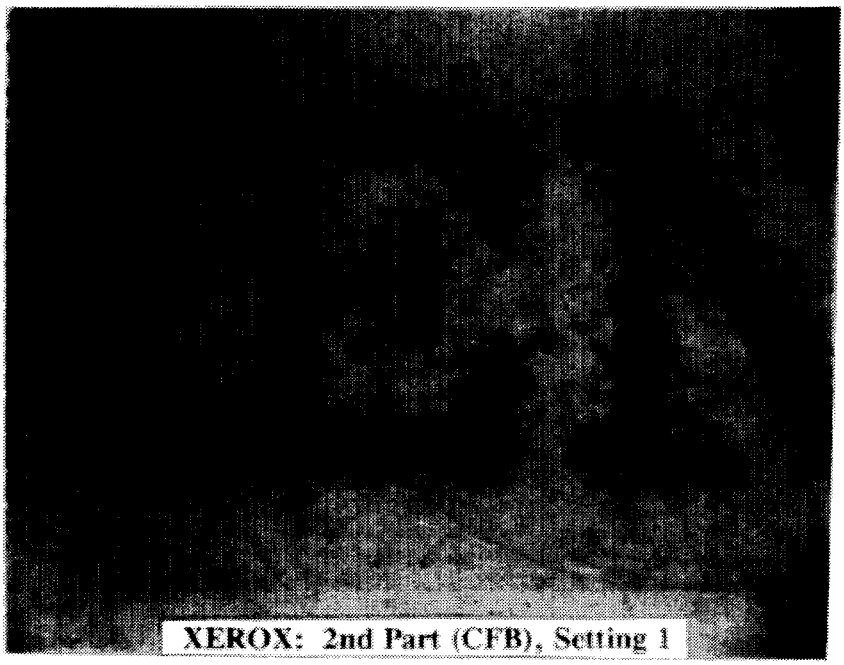
Figure 2C:
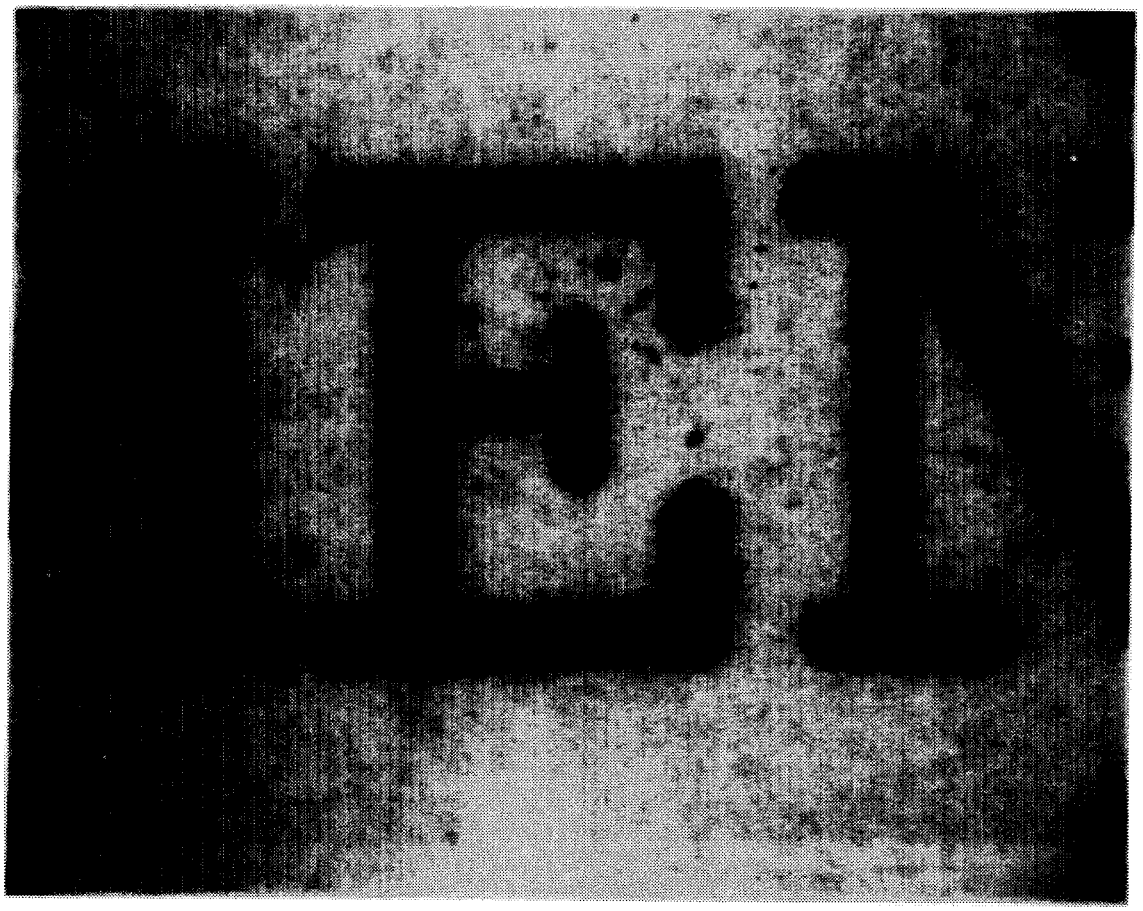
Figure 3:
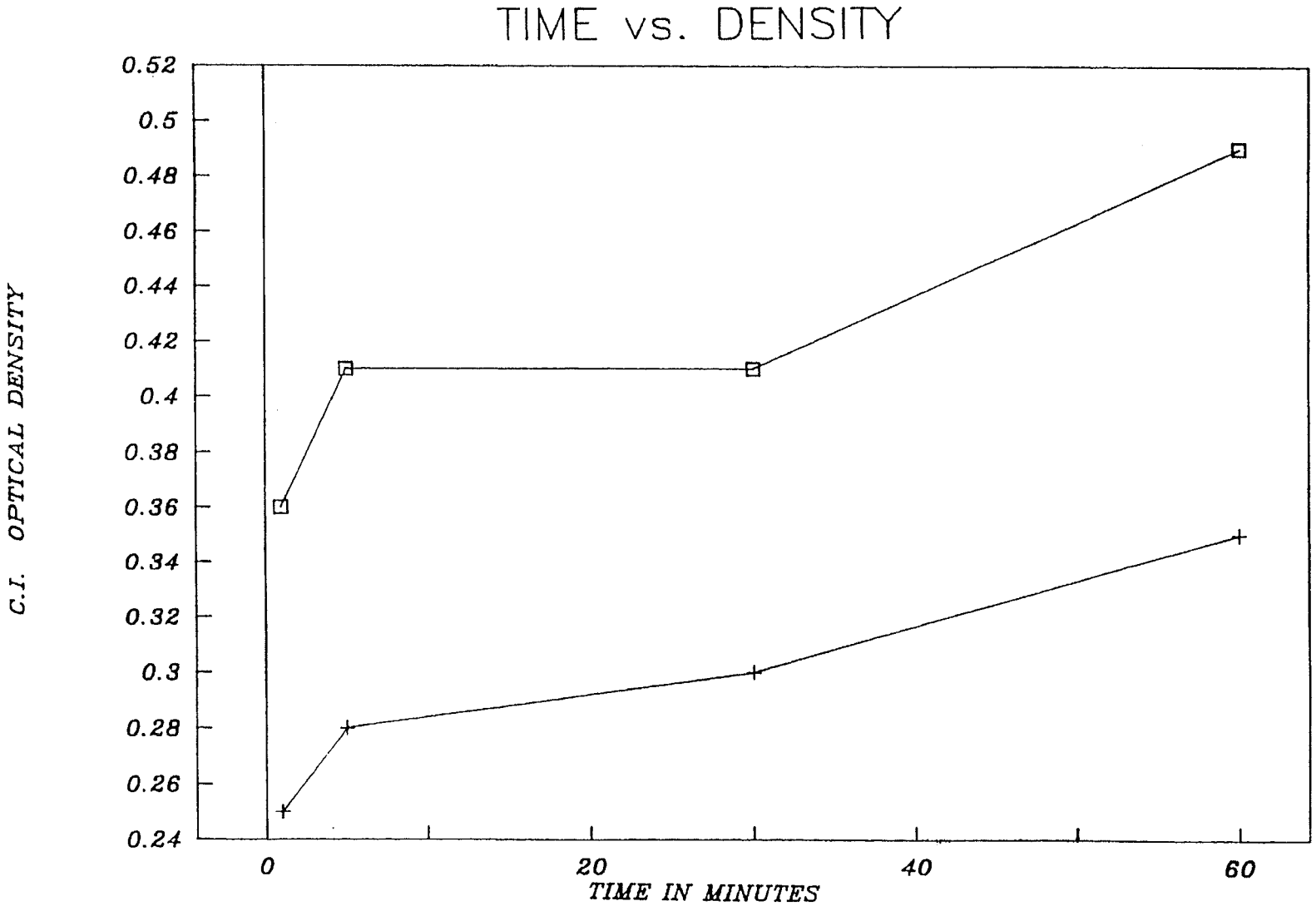
FIG. 3 is a graph showing the optical density of the image formed using the present CB/CF system versus time compared to a prior art system.

Sheets coated with the present CB composition also provide crisper, clearer, darker, more defined images on the underlying CF sheets. Good imaging characteristics are obtained even for the lowest sheets in a set containing multiple sheets. This is further illustrated by the results shown in the Figures. The image legibility obtained using the present method and composition was compared to a commercially available product. Visual observation of the resolution and density of the images obtained using both CB coatings are shown in FIG. 1. The image made on the CF sheet by applying pressure to the top sheet coated with the CB formulation described herein is clearer, crisper, denser and visually brighter. FIG. 2 shows the clarity of an original typed image (C) to images produced using the present CB formulation (A) and the commercial product (B). The present formulation provided darker, more legible copies. The rate of color development of the images made using the present CB formula and method are shown in FIG. 3. Images made using the present formula (represented by the square ( ) was compared to images made using the commercial product (represented by the plus sign (+)). The present formula developed a denser image in a shorter time frame.

Carbonless sheets of the present invention exhibit superior resistance to non-specific development, therefore permitting indicia to be reproduced xerographically onto the sheets. CF sheets backing the CB sheets of the present invention resist non-specific development due to pressure breaking of the CB sheets during copying because the present CB sheets are less subject to damage by rubbing (i.e., by feed rollers or belts, stationary surfaces and fuser roll pressure) in the copier or printer. Spacer material is securely held within the CB coating matrix, as evidenced by the scanning electron micrographs of the CB coated surface shown in FIG. 4. Undamaged CB surfaces do not transfer foreign material to the paper transport, photoreceptor or fuser assemblies in the copier machine.

The invention will now be further illustrated by the following examples, which are not intended to be limiting in any way.

EXAMPLES

Example 1

A high solids content black marking CB coating composition was made according to the following procedure:

An aqueous solution of carboxymethyl cellulose (CMC) was prepared by mixing together:

| | |
|---|---|
| water | 1600 parts |
| and | |
| CMC (CMC-7L, Hercules Inc.) | 150 parts |

to form a 9.0% solids solution. To this solution was added 17.6 parts of a polyethylacrylate/methyl methacrylate copolymer (Carboset 514H, B. F. Goodrich, Inc.). To the resulting mixture was added:

| | |
|---|---|
| deoderized kerosene (Penreco) | 333.1 parts |
| oil dye | 677.3 parts. |

The oil dye was prepared by mixing 615 parts of a mixture of alkyl biphenyl (Tanacol BB, Sybron, Inc.) with 5.8 parts Crystal Violet Lactone (Hilton-Davis Co.), 28.9 parts Pergascript Olive I-G (Ciba-Geigy) 10.9 parts Copikem 20 (Hilton-Davis Co.) and 16.7 parts PSD-150 (Nippon Soda) for a total of 677.3 parts. The mixture was stirred during the addition to form an oil-in-water emulsion. To the emulsion was added 122.7 parts of a polyamideepichlorohydrin crosslinker (Kymene 557N). Then 13.4 parts of 1.4% aqueous aluminum nitrate solution is added. To this mixture, 1261.4 parts of a starch dispersion comprising a 32.0% solids dispersion of 10–25 micron starch particles in water is added. At this point, the emulsion has a solids content of about 32%.

Example 2

A high solids content emulsion was prepared as described in Example 1 except that a fluorescent whitening agent (Tinopal HST, Ciba Geigy) was added.

Example 3

Multilayered CB sheets and CF sheets were placed in face-to-face configuration and were tested for pressure damage. The test sheets consisted of paper which was coated with the present CB formulation of Example 1 and a standard CF formulation, and a commercially available product (Xerox brand) CB/CF sheets.

The sheets were tested for both dynamic and static pressure resistance. Dynamic pressure resistance was tested according to the ASTM F 598 procedure. Briefly, with this procedure, a receptor (CF) test unit of fixed area is held in position under fixed pressure while a donor (CB) test unit of specified length is drawn under it by controlled mechanical means. The receiver coated side of the CF sample and the donor coated side of the CB sample must be in contact. The degree of color development, as indicated by the contrast ratio between the CF specimen and the background is used to calculate the damage factor. The test for dynamic pressure resistance was carried out using an 8 lb. weight using test samples having an area of 4 square inches. The degree of color development on the CF sheets was measured using a reflectometer as described in the ASTM procedure. Substantially less smudging was observed on the CF surfaces adjacent the CB sheets of the present invention than the commercial CB/CF product.

Six ply collations of (CB/CF/CB/CF/CB/CF) the present product and two different commercial brand coated papers were tested for static pressure resistance. The six-ply sets were subjected to 70 psi of pressure at a temperature of 400° F. of 0.05 seconds. This test was designed to demonstrate the resistance to capsular damage of the CB coating related to heat and nip effects during processing. The 2nd, 4th and 6th CF sheets were visually examined for visible smudging due to non-specific development. Both commercial sheets showed considerable smudging on the 2nd and 4th sheets and faint smudging on the 6th sheet. The sheets of the present invention showed little visible smudging on the second sheet and no visible smudging on the 4th and 6th sheets.

Example 4

Figure 4A:
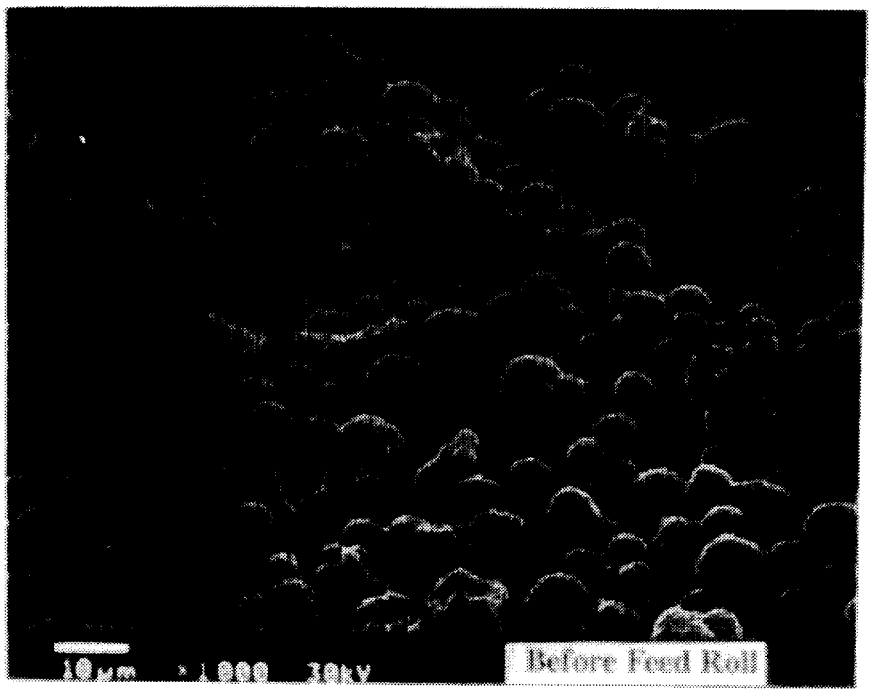
FIG. 4 comprises photomicrographs showing the CB coatings on sheets of paper before and after the sheets were passed through the fuser rolls of a copier: commercial brand CB sheet before (A), and after (B) being passed through the fuser rolls; the present CB sheets before (C), and after (D) being passed through the fuser rolls.
Figure 4B:
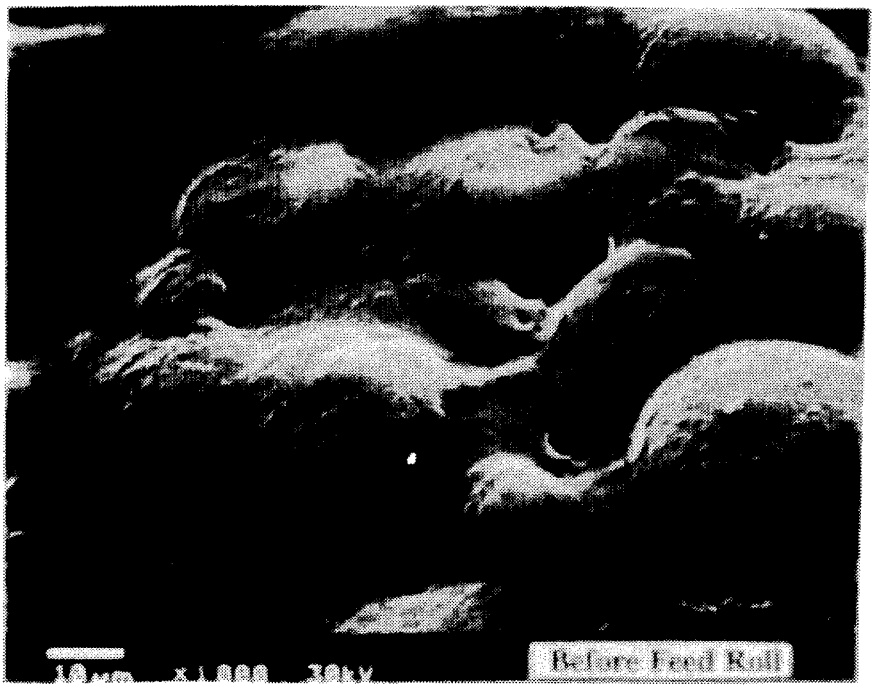
Figure 4C:
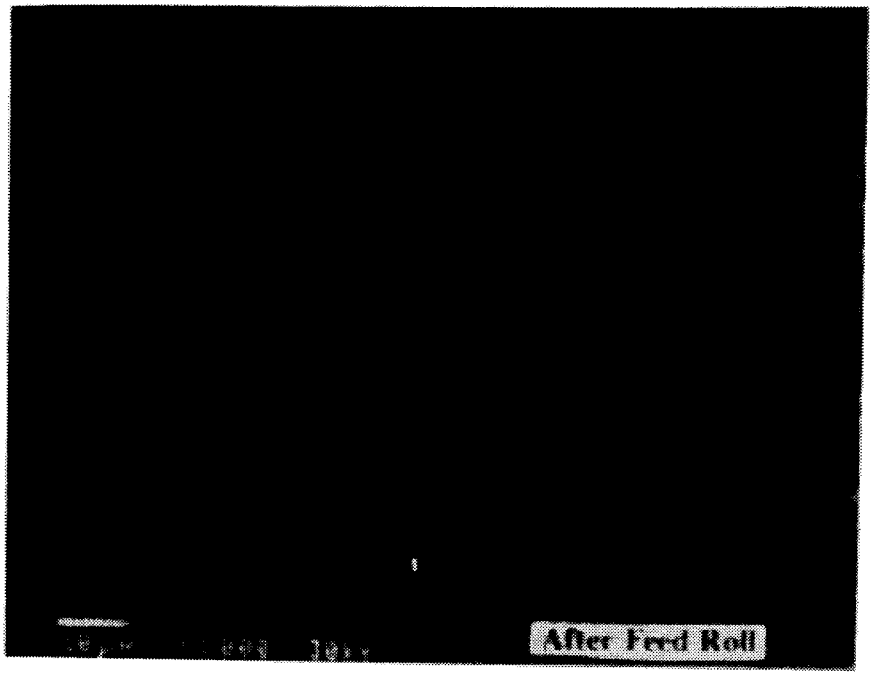
Figure 4D:
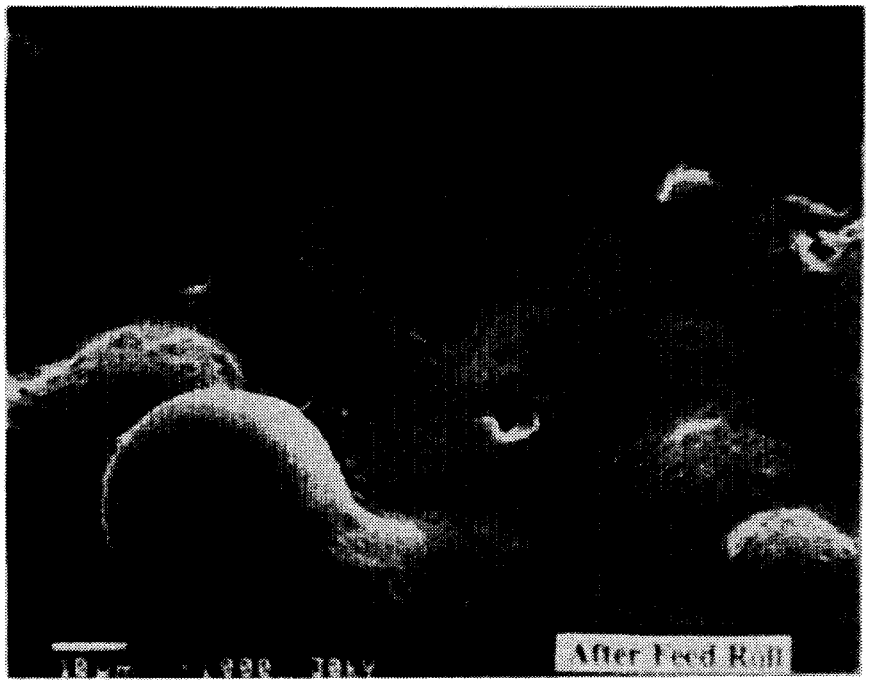

Samples of both types of sheets described in Example 3 were imaged in a Xerox 9900 printer. CB coating damage from the feed rolls was visible only for the Xerox brand product when viewed with oblique lighting. The sheets then were examined under a microscope at 1000×magnification to determine the extent of capsular damage. The results are shown in FIG. 4. As shown in FIG. 4, the commercial brand CB before being fed through the printer consists of intact microcapsules, as shown in FIG. 4A. After going through the printer many of the capsules are broken, as shown in FIG. 4B. Since the capsules contain the oil soluble dye, the capsule breakage results in release of the dye and subsequent non-specific development of the underlying CF sheet. FIG. 4C shows the present CB coating before the sheet was fed through the printer's feed rolls. The CB coating is a smooth intact coating having pockets containing the oil-soluble dye. The coating emerged substantially intact from the printer, as shown in FIG. 4D. Little capsular damage was evident, which means that little or no color-forming dye escaped.

Equivalents

Those skilled in the art will recognize, using routine experimentation, many equivalents to the specific embodiments described herein. Such equivalents are intended to be encompassed by the following claims.

We claim:

1. A method for producing carbonless forms having printed indicia on a surface thereof and blank spaces for insertion of alphanumeric data by writing or impact typing, said method comprising:

a. coating the back of a cellulosic sheet with a formulation which forms a uniform intact flexible CB layer, said formulation comprising an emulsion of an oil containing an acid-developable leuco dye in an aqueous solution of carboxymethyl cellulose having a degree of substitution of about 0.65 to about 0.85, an amount of acrylic resin which is less than the amount of carboxylmethyl cellulose, a salt of a polyvalent metal and an organic crosslinker, such that the total solids content in the formulation is at least 25% by weight, wherein said leuco dye is contained within said intact CB layer and said intact CB layer resists rupture sufficient to release said dye at pressures applied to the sheet of up to about 70 PSI;

b. loading a plurality of said sheets into the copy paper feed tray of a xerographic copy machine;

c. providing a master sheet having said printed indicia imprinted thereon; and d. activating a copy cycle in said xerographic copy machine to transfer a facsimile of the printed indicia from said master sheet to the surface of each of a plurality of the sheets opposite said layer, wherein said CB layer remains intact after being subjected to said pressures of up to about 70 PSI applied to said sheets during xerography.

2. The method of claim 1 wherein step (a) is effected by applying a CB coating composition comprising:

(i) about 100 parts by weight of said carboxymethyl cellulose;

(ii) less than 50 parts by weight of said acrylic resin;

(iii) about 1 to about 12.2 parts by weight of said salt of a polyvalent metal;

(iv) about 10 to 150 parts by weight of said crosslinker which is reactive with the carboxymethyl cellulose and the acrylic resin;

(v) about 100 to 500 parts by weight of spacer particles; and (vi) about 300 to 1000 parts by weight of said oil and said dye.

3. The method of claim 2 wherein the dispersion further comprises a fluorescent whitening agent.

4. The method of claim 2 wherein the acrylic resin is present in an amount of from about 10 to about 20 parts by weight of the coating composition.

5. The method of claim 2 wherein the metal salt comprises aluminum nitrate or aluminum acetate.

6. The method of claim 1 wherein the sheets further comprise a color-forming layer on the front of the sheets including a color forming material which reacts with the dye in the CB layer to form color at the area of contact when pressure is applied.

7. A method for producing carbonless forms having printed indicia on a surface thereof and blank spaces for insertion of alphanumeric data by writing or impact typing, said method comprising:

a. coating the back of a cellulosic sheet with a CB emulsion composition comprising:

(i) about 100 parts by weight of carboxymethyl cellulose having a degree of substitution of about 0.65 to about 0.85, (ii) less than 50 parts by weight of an acrylic resin, (iii) about 1 to about 12.2 parts by weight of a salt of polyvalent metal, (iv) about 10 to 150 parts by weight of a crosslinker reactive with the carboxymethyl cellulose and the acrylic resin, (v) about 100 to 500 parts by weight of spacer particles, (vi) about 300 to 1000 parts by weight of oil and an acid-developable leuco dye, wherein said emulsion is dried to form a uniform intact flexible layer containing said acid-developable leuco dye, wherein said intact layer resists rupture sufficient to release said dye at pressures applied to the sheet of up to about 70 PSI;

b. loading a plurality of said sheets into the copy paper feed tray of a xerographic copy machine;

c. providing a master sheet having said printed indicia imprinted thereon; and d. activating a copy cycle in said xerographic copy machine to transfer a facsimile of the printed indicia from said master sheet to the surface of each of a plurality of the sheets opposite said layer, wherein said CB layer remains intact after being subjected to said pressures of up to about 70 PSI applied to said sheets during xerography.

* * * * *